United States Patent [19]

Bolton

[11] 4,082,278

[45] Apr. 4, 1978

[54] GAME DEVICE

[75] Inventor: Douglas R. Bolton, Palatine, Ill.

[73] Assignee: Cadaco, Inc., Chicago, Ill.

[21] Appl. No.: 732,907

[22] Filed: Oct. 15, 1976

[51] Int. Cl.[2] ..... A63F 9/00
[52] U.S. Cl. ..... 273/94 R
[58] Field of Search ..... 273/94 R, 157 A; 282/29 B

[56] References Cited

U.S. PATENT DOCUMENTS

| | | | |
|---|---|---|---|
| 2,117,372 | 5/1938 | Smith et al. | 282/29 B |
| 2,260,467 | 10/1941 | LeMay | 273/94 R |
| 3,375,007 | 3/1968 | Meyer | 273/94 R |
| 3,411,221 | 11/1968 | Clark | 273/157 A UX |

OTHER PUBLICATIONS

Photocopies of Rules and Components of "Foto-Electric Football" Copyright 1959, by Cadaco-Ellis, Inc.

*Primary Examiner*—Anton O. Oechsle
*Attorney, Agent, or Firm*—Wegner, Stellman, McCord, Wiles & Wood

[57] ABSTRACT

Apparatus for playing a game, such as a simulated athletic game, or the like, wherein a sheet indicating action taken by a first player is covered by a sheet indicating action taken by an opponent player. The overlying sheet is light-transmissive so that the interrelationship between the two actions taken by the opposing players may subsequently be seen by means of ambient light so as to indicate the results of the joint play action. Interlock structure may be provided to permit a variation in the disposition of one or both of the opponents' play sheets so as to provide a further chance variation in the joint play results.

14 Claims, 7 Drawing Figures

| | | | | | | | | | | | | | | | |
|---|---|---|---|---|---|---|---|---|---|---|---|---|---|---|---|
| | 3 | 4 | 5 | 6 | 7 | 8 | 9 | 10 | 11 | 12 | 13 | 14 | 15 | 16 | 17 | 18 |
| | | | | 10 | 10 | 5 | 15 | 10 | 15 | 20 | 15 | 10 | 5 | 25 | 30 | 35 |
| | TO | 70 | | 5 | 15 | 15 | 12 | 10 | 15 | 20 | 10 | 15 | 30 | 40 | 50 | 60 |
| | | | 30 | 35 | 20 | 25 | 30 | 35 | 40 | 40 | 45 | 50 | — | 60 | 65 | 70 |
| | 40 | 25 | 0 | | 2 | 5 | 9 | 7 | 3 | 8 | 10 | 15 | 20 | 30 | 50 | 70 |
| | | | 20 | 25 | 15 | 15 | 20 | 25 | 30 | 35 | 40 | 45 | — | 40 | 25 | 35 |
| | TO | 20 | 1 | 0 | 2 | 5 | 0 | 3 | 0 | 5 | 10 | 12 | 15 | 20 | 25 | 40 |
| | TO | 30 | 3 | 2 | 1 | 0 | 0 | 3 | 5 | 5 | 8 | 15 | 20 | 25 | 30 | 35 |

GAME DEVICE

BACKGROUND OF THE INVENTION

1. Field of the Invention

This invention relates to apparatus for playing games and in particular to apparatus for playing simulated games wherein defensive action by a defensive player is effected in opposition to offensive action taken by an opponent offensive player.

2. Description of the Prior Art

In one well known game marketed by the assignee hereof and identified by the trademark "Foto-Electric Football", a plurality of light-transmitting offensive play and defensive play cards are placed in superposed relation over a light screen. The players are not apprised of the results of the joint play action resulting from the superposed cards until the light screen is gradually moved to permit light to pass through the superposed cards showing the path of the ball and the extent of its progression against the selected defense.

A game apparatus of this type is disclosed in U.S. Pat. No. 2,260,467 of Alan B. LeMay. As disclosed therein, a movable light screen having opaque portions is provided with the selected offensive and defensive cards placed temporarily in superposed relationship with the screen to determine the combined play action. The upper card is provided with opaque portions and translucent portions to indicate the desired line of play. The lower card is provided with opaque portions and light-emitting portions adapted to register with part of the translucent portions of the upper cards whereby withdrawal of the underlying light screen opaque portions indicates progressively by a path of light through the registered translucent portions of both cards the play action resulting from the combined card selection.

To provide the necessary illumination, a pair of electric light bulbs is connected in parallel with a source of electric current through a control switch. A metal reflector is secured to the frame of the game to reflect as much light as possible through a window underlying the selected cards. The switch may be designed to automatically operate the electric light as a function of changing of the cards.

SUMMARY OF THE INVENTION

The present invention comprehends an improved form of such a game apparatus eliminating the need for the illuminating means. By eliminating the requirement for electrical connection, the game effectively comprises a portable, universally playable game.

The game of the present invention may be played utilizing ambient light and avoiding the requirement of playing such games in a somewhat darkened room. Heretofore, heat problems attended the use of the conventional 110v. Electric lamps limited the lighting efficiency of the illumination means. Further, the need for providing diffused lighting over a substantial area raised additional problems including difficulty in accurately determining the superposed relationship of the cards.

The present invention provides an improved accurately discernible superposed position of the selected cards for accurate determination of the play action.

Additionally, the invention comprehends providing means for selectively positioning the selected cards in laterally adjusted relationship to each other to provide additional chance results in the play action. In the illustrated embodiment, a pair of interlocking pins are provided permitting the selected cards to be superposed in any one of a plurality of different laterally related positions.

The selected offense card may be retained in an opaque envelope which may be slowly withdrawn from the card with the offense card in the envelope and the overlying defense card retained as a unit so as to gradually show the play action resulting from the combined offensive and defensive superposed cards. The interlocking pins may be utilized for retaining the cards in such association as a unit with the envelope being withdrawn from the cards so held by the interlocking pins.

In the illustrated embodiment, each of the cards is provided with a pair of sets of apertures for selectively receiving the pins with the apertures being provided at one end of the respective cards so as to be exposed outwardly of the envelope in which the play indicating portion of the card is received.

In the illustrated embodiment of the game, the game comprises a football game. The offensive card may comprise the lowermost card and may be opaque. The overlying card may be the defensive card and is preferably transparent with the defensive player position being illustrated thereon in opaque material. Thus, upon removal of the envelope, the line of offensive play movement may be seen with relationship to the selected positioning of the defensive players whereby ready determination of the results of the combined selected offensive play and selected defensive player deployment may be made.

The game apparatus may be utilized in connection with many different types of games, including not only athletic-type games, but stock market games, other business games, etc.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
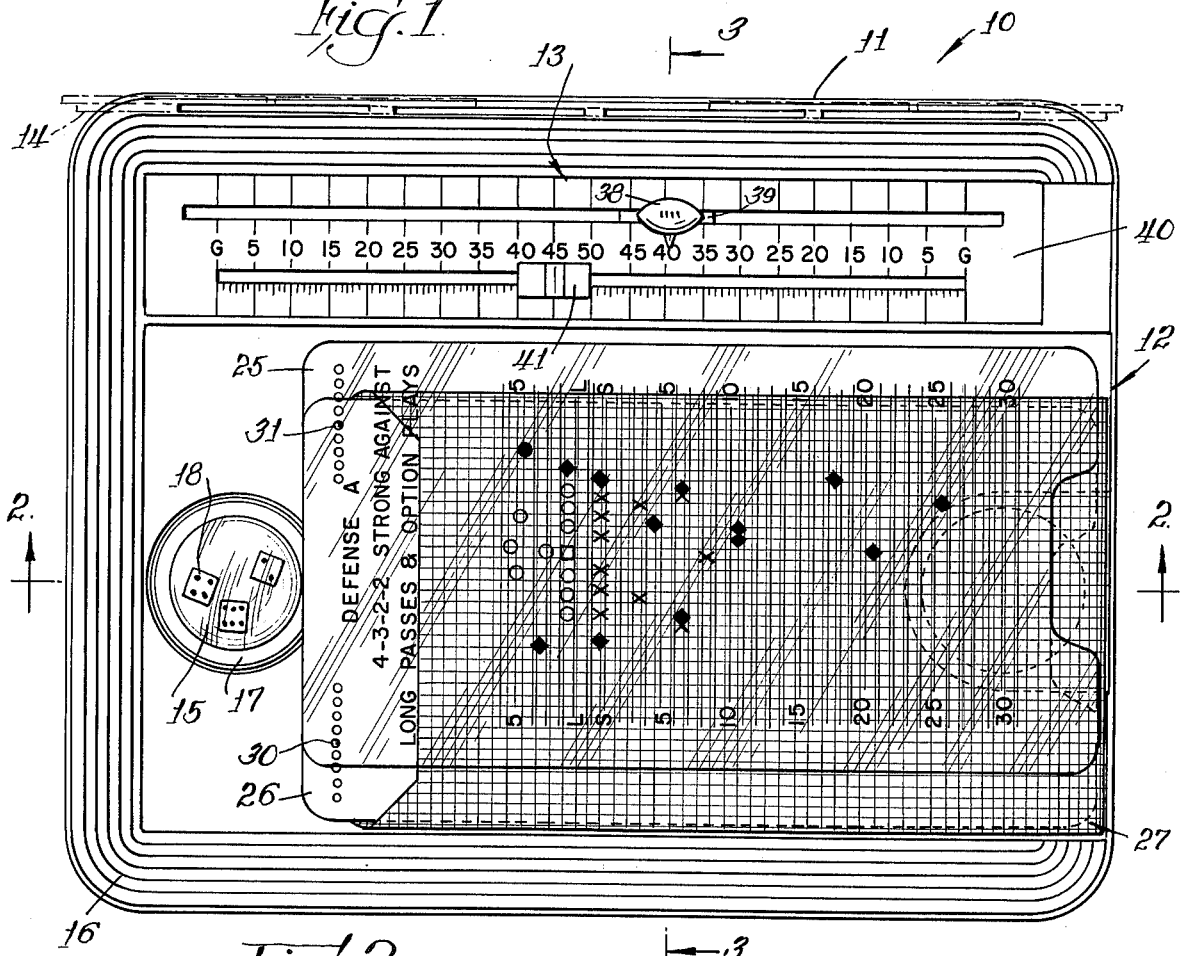
FIG. 1 is a plan view of a game apparatus embodying the invention.

In the exemplary embodiment of the invention as disclosed in the drawing, a game apparatus generally designated 10 is shown to comprise a gameboard 11 defining a playing area generally designated 12, a ball-locating portion generally designated 13, a scoreboard portion generally designated 14, and dice-retaining portion generally designated 15. In the illustrated embodiment, the gameboard is provided with a tiered peripheral portion 16 simulating stands surrounding a football field.

The dice portion 15 may include a dice cup 17 and a plurality of dice 18. The scoreboard portion 14 may include indicia generally designated 19 for use in conjunction with the dice 18 in determining blocked kicks, field goals, fumbles, points after touchdown. The scoreboard may further include a quarter indicator 20, the home team score indicator 21, the visitor team score indicator 22, a down indicator 23, and an indicator to show the number of plays for quarter designated 24.

The ball-locating portion may include a movable simulated ball 42 carried on a suitable slide 43 movable relative to a grid 44 simulating the line markers of the conventional football field. A slidable 10-yard marker 45 may be provided for indicating the first down yardage information.

Figure 2:
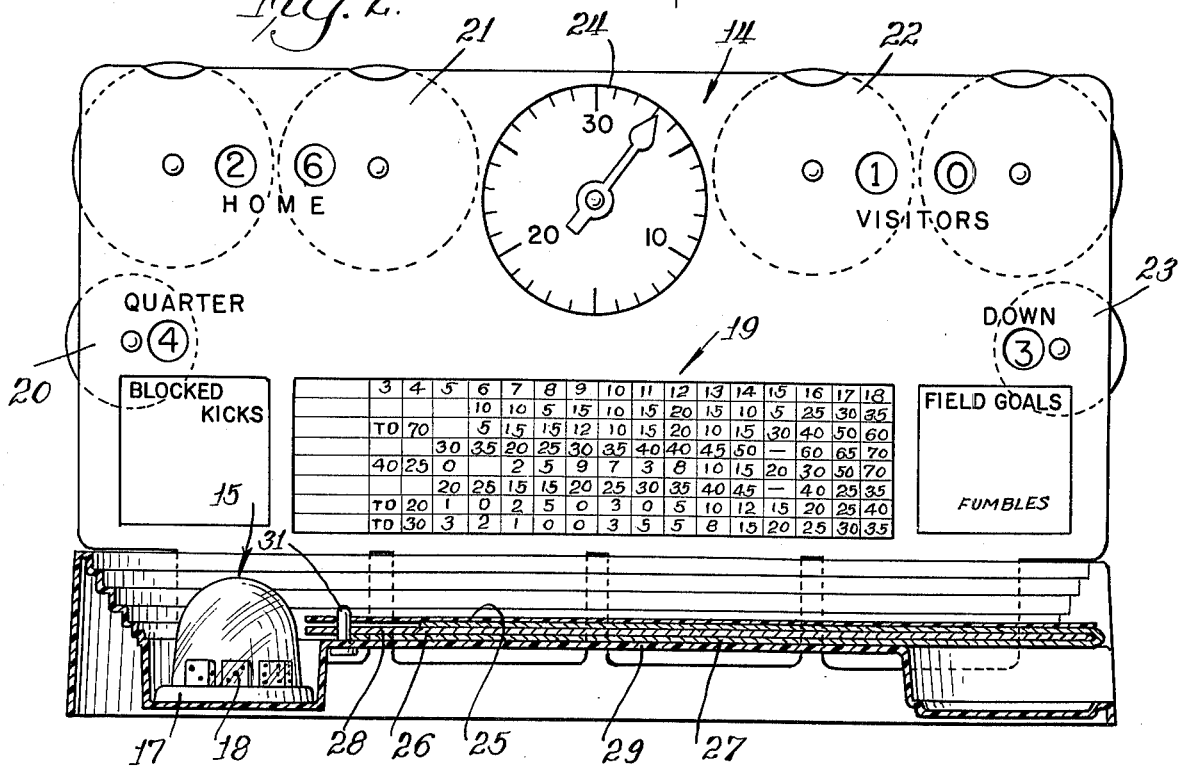
FIG. 2 is a vertical section thereof taken substantially along the line 2—2 of FIG. 1.
Figure 3:
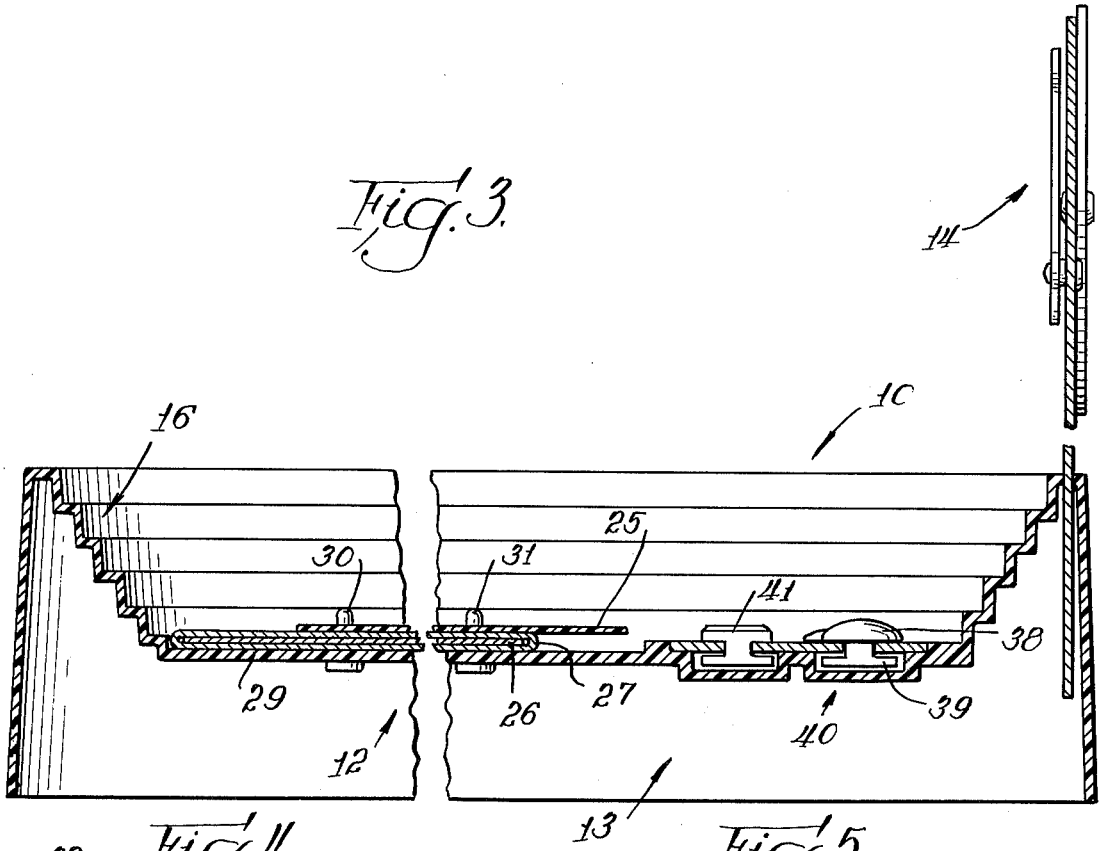
FIG. 3 is a transverse vertical section thereof taken substantially along the line 3—3 of FIG. 1.

The present invention is concerned with the means for indicating the play action as determined by selection of different offensive plays and different defensive plays by the opposing players. More specifically, the play action is determined by the superposition of a defensive play card, such as card 25, over an offensive play card, such as card 26, illustrated in FIG. 2. In the game-playing positioning of the cards, the offensive card 26 is received in an opaque envelope 27 with a projecting portion 28 extending outwardly from one end of the envelope. The defensive card is placed in overlying relationship to the envelope so as to be also in overlying relationship to the offensive card 26 within the envelope. The playing portion 12 defines a table portion 29 on which the envelope 27 with the selected offensive card 26 received therein is placed prior to the placement of the selected defensive card thereover.

Figure 4:
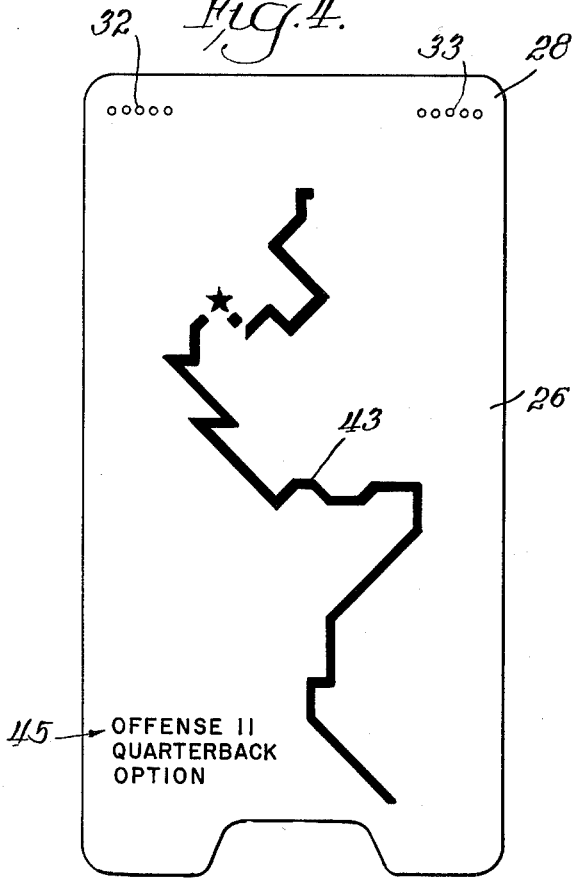
FIG. 4 is a plan view of an offensive play card for use in the game apparatus.
Figure 5:
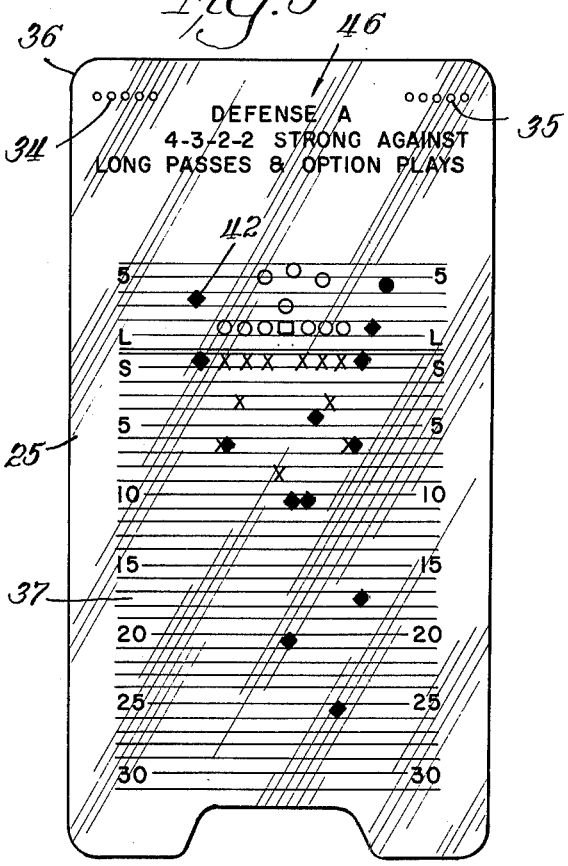
FIG. 5 is a plan view of a defensive play card for use in the game apparatus.
Figure 6:
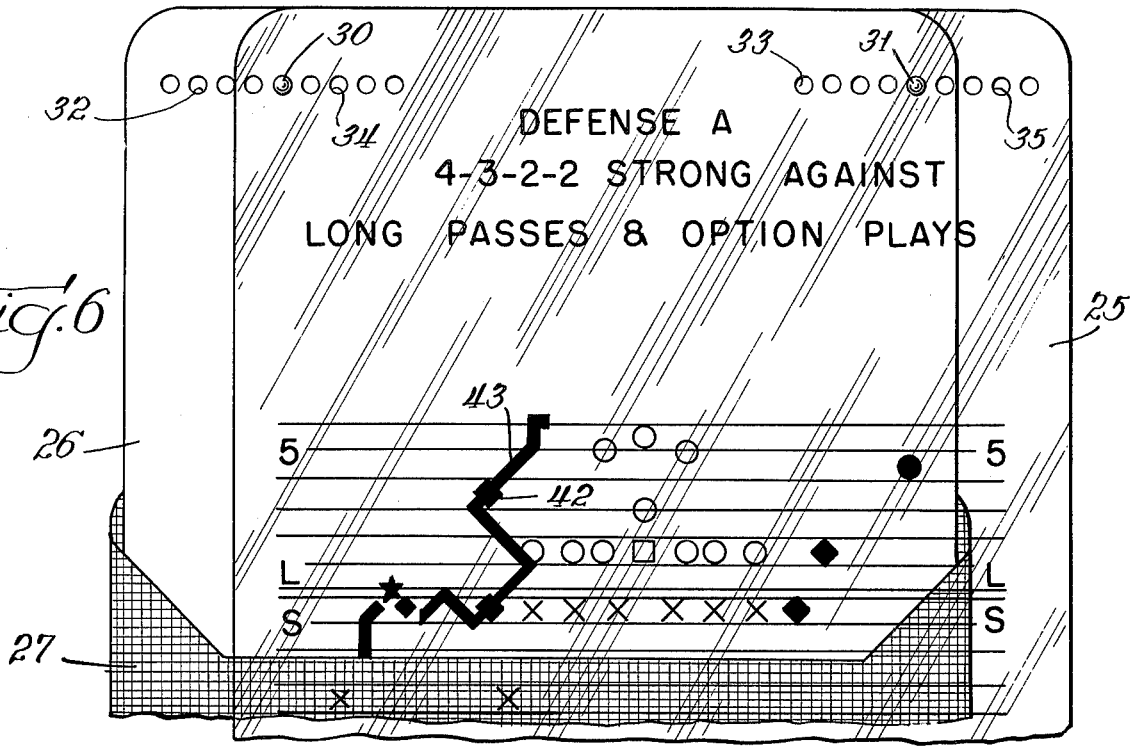
FIG. 6 is a fragmentary enlarged plan view illustrating one arrangement of the play cards as during the removal of the envelope in gradually displaying the combined play action.
Figure 7:
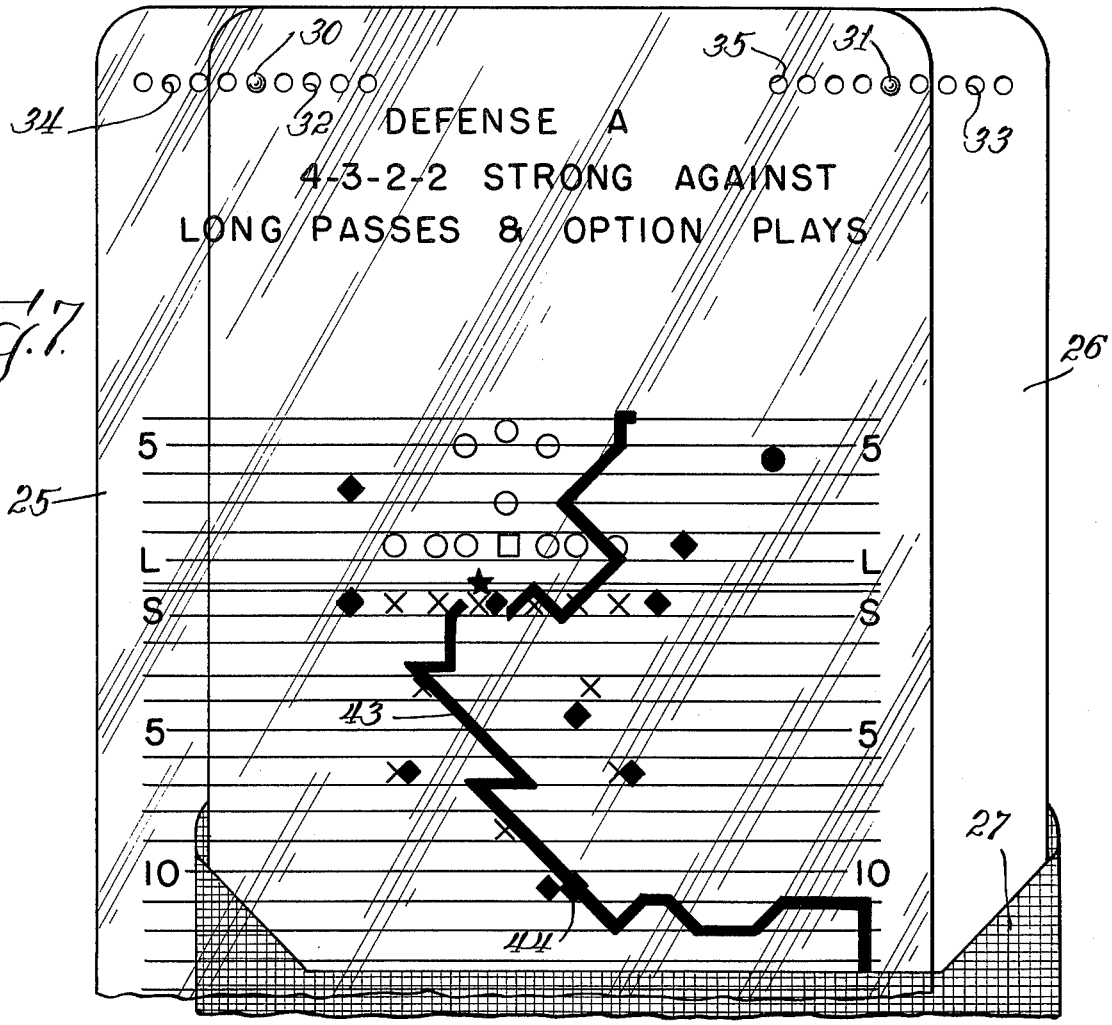
FIG. 7 is a view similar to that of FIG. 6 but with the cards arranged in a different position and with the envelope substantially fully withdrawn to show the completed play.

Table portion 29 is provided with a pair of upwardly projecting pins 30 and 31. As shown in FIGS. 4 and 5, offensive card 26 is provided with a pair of sets of apertures 32 and 33 and defensive card 25 is provided with a corresponding pair of sets of apertures 34 and 35. Apertures 32 and 33 are provided in the end portion 28 of card 26 and apertures 34 and 35 are provided in a corresponding end portion 36 of card 25. As illustrated in FIGS. 6 and 7, the apertures 32 and 34 are adapted to receive pin 30 and apertures 33 and 35 are adapted to receive pin 31 so as to accurately locate the defensive card in superposed position to the offensive card and to permit a selective lateral adjustment of the cards when placed on the playing portion table 29 to provide an additional chance factor in the playing of the game. Synergistically, the pins further provide means for retaining the cards in accurate superposed relationship while envelope 27 is gradually withdrawn from the offensive card to permit gradual determination of the combined play action.

More specifically, defensive card 25 is formed of a transparent material permitting observation of the subjacent offensive card 26 by conventional ambient illumination. Envelope 27 is formed of any suitable opaque material, such as black paper, and thus when the offensive card 26 is placed therein after selection thereof by the offensive player, the thusly enveloped card may be placed on the game-playing portion table 29 with the pins 30 and 31 extending through any one of the different paired apertures 32 and 33 as selected by the offensive player. At this time, the selected card will not be apparent to the defensive player and he must select a suitable defensive card 25 to provide a combined play action with the selected offensive card which will become apparent upon removal of the black envelope from enveloping relationship with the selected offensive card and with the selected defensive card arranged to have the pins 30 and 31 project through selected paired apertures 34 and 35 thereof.

While as indicated above the invention comprehends that the game apparatus may be utilized in conjunction with any type of simulated game, in the illustrated embodiment comprehending a football game, the offensive play is illustrated, as shown in FIG. 4, by the path of movement of the football on the selected offensive card. The illustrated offensive card 26 in FIG. 4 represents only one of a plurality of different offensive cards, each of which has a different play illustrated thereon. The illustrated play comprises a quarterback option play.

The offense cards may be formed of opaque material with the play line being shown thereon in readily observable printing. As indicated above, the defense card is preferably formed of transparent material permitting discernment of the underlying play line of the offense card upon removal of the envelope 27. As shown in FIG. 5, the defense card shows the player positions for a given defense as selected by the defensive game player. The player positions are superposed on a grid 37 corresponding to yard lines of the football field. Coincidence of a defensive player, as shown on the defense card 25, with the line of movement of the offensive card indicates the end of the play action. In the event no defensive player is found to be superposed on the offense play path, the offensive play will be considered to have continued on to a touchdown. Otherwise, the gain or loss as determined by the coincidence of the first defensive player with the offensive play path is taken as the result of the play and indicated suitable position of the football marker 38.

Referring to FIGS. 6 and 7, the combined play action resulting from the selection of the cards 26 and 25 by the opposing players but utilizing different placements thereof on the pins 30 and 31 is illustrated. Thus, as shown in FIG. 6, where the offensive player has selected offensive card 26 and has placed it on pins 30 and 31 with the pins projecting through the rightmost of the apertures 32 and 33 and where the defensive player has selected card 25 and placed it on pins 30 and 31 with the pins projecting through the leftwardmost of the apertures 34 and 35, the removal of envelope 27 shows that the line of play is intercepted almost immediately by the superposition of the defensive player indicium 42 with the offensive line of play 43 resulting in a 3-yard loss.

Referring now to FIG. 7, a reverse arrangement of the offensive and defensive cards results in a different combined play action. Thus, as shown in FIG. 7, where the defensive card is placed in its leftwardmost position and the offensive card is placed in its rightwardmost position on pins 30 and 31, the line of play 43 does not coincide with any of the defensive players until it reaches defensive player 44 resulting in an 11-yard gain.

As discussed above, the use of the transparent overlying card 25 permits the play action to be determined by normal ambient illumination. Normally such illumination is diffused and an accurate determination of the intersection of the defensive player indicia and the play action line may be readily determined. As it is unnecessary to provide electrical power supply to the game, the game comprises an improved portable universally playable game. As further indicated briefly above, in addition to providing a chance element in the relative placement of the selected offense and defense cards, the pins 30 and 31 provide means for retaining the selected cards as a unit during the withdrawal of the envelope 27 for facilitated playing of the game. The use of the pins further causes accurate alignment of the selected cards so as to avoid questions of interception of the offense play line by the defensive player indicia.

To further provide improved skillful play in the playing of the game, the individual cards may be identified by the proper play designation, such as quarterback option designation 45 of card 26 and "Defense A 4-3-2-2 (Strong Against Long Passes and Option Plays)" designation 46 of card 25. Thus, the game may be utilized as an educational game for training players of actual football games.

The game board may be formed of any suitable material. In the illustrated embodiment, the game board is formed of a suitable molded synthetic resin. The defense and offense cards may comprise sheets of suitable material. In the illustrative embodiment, the sheets are formed of a synthetic resin.

The foregoing disclosure of specific embodiments is illustrative of the broad inventive concepts comprehended by the invention.

I claim:

1. Apparatus for playing a game wherein defensive action by a defensive player is effected in opposition to offensive action taken by an opponent offensive player, said apparatus comprising:

a plurality of opaque offense sheets each having thereon a different one of a plurality of different offensive plays to be selected by said offense player;

means for removably covering the selected sheet so as to prevent observation thereof by the defensive player;

a plurality of defense sheets each having thereon a different one of a plurality of different defensive plays to be selected by said defensive player; and means for placing the selected defensive sheet in fixed overlying relationship to said selected offensive sheet with the covering means disposed therebetween, said defensive sheet being light transmissive to permit use of ambient light in the viewing of said offensive sheet through said defensive sheet upon removal of said covering means with said selected sheets mounted in said overlying relationship whereby said selected defensive play may be seen superposed on said selected offensive play for indicating the competitive result of the joint play by said offense and defense players.

2. The game playing apparatus of claim 1 wherein said covering means comprises means defining a pocket receiving said selected offensive sheet permitting a gradual withdrawal of the pocket defining means while maintaining the selected offense sheet in fixed association with the selected defense sheet to provide a gradual development of the entire joint play.

3. The game playing apparatus of claim 1 wherein interlocking means are provided on the offensive and defensive sheets for removably retaining the selected sheets together in said overlying relationship.

4. The game playing apparatus of claim 1 wherein means are provided on said sheets to permit selective positioning of the overlying defensive sheet in any one of a plurality of different adjusted positions over said offensive sheet to provide a chance variation in the relationship of the selected defensive play to the selected offensive play.

5. The game playing apparatus of claim 1 wherein said game comprises an athletic game.

6. The game playing apparatus of claim 1 wherein said covering means comprises means defining a pocket receiving said selected sheets.

7. Apparatus for playing a game wherein defensive action by a defensive player is effected in opposition to offensive action taken by an opponent offensive player, said apparatus comprising:

a plurality of offense sheets each having thereon a different one of a plurality of different offensive plays to be selected by said offense player;

means for removably covering the selected sheet so as to prevent observation thereof by the defensive player;

a plurality of defense sheets each having thereon a different one of a plurality of different defensive plays to be selected by said defensive player; and adjustable means for releasably interlocking the selected defensive sheet in overlying relationship to said selected offensive sheet and said covering means in any one of a plurality of different adjusted positions over said offensive sheet to provide a chance variation in the relationship of the selected defensive play to the selected offensive play, said defensive sheets being light transmissive to permit viewing of said offensive sheet through said defensive sheet upon removal of said covering means with said selected sheets mounted in said overlying relationship whereby said selected defensive play may be seen superposed on said selected offensive play for indicating the competitive result of the joint play by said offense and defense players.

8. The game playing apparatus of claim 7 wherein said interlocking means comprises cooperating male and female means.

9. The game playing apparatus of claim 7 wherein said interlocking means comprises a registering element, and a plurality of apertures in said defensive sheet adapted to selectively receive said registering element.

10. The game playing apparatus of claim 7 wherein said interlocking means comprises a registering element, and a plurality of apertures in said defensive sheet adapted to selectively receive each of said offensive and defensive sheets.

11. The game playing apparatus of claim 7 wherein said apparatus includes a game board and a registering element fixed to said game board, said sheets having a plurality of apertures adapted to selectively receive said registering element.

12. The game playing apparatus of claim 7 wherein said interlocking means comprises a pair of pins selectively received in selected ones of a pair of sets of apertures.

13. The game playing apparatus of claim 7 wherein said game comprises a football game and said offensive sheets display different paths of offensive ball movement, said apparatus further including means for retaining the selected offensive sheet with the path of ball movement in any one of a plurality of different laterally shifted positions.

14. The game playing apparatus of claim 7 wherein said game comprises a football game and said defensive sheets display different arrangements of the defensive team players, said apparatus further including means for retaining the selected defensive sheet with the player arrangement in any one of a plurality of different laterally shifted positions.

* * * * *